United States Patent [19]

Handa

[11] 3,937,181

[45] Feb. 10, 1976

[54] MAGNETIC BRUSH TYPE DEVELOPING MECHANISM IN ELECTROPHOTOGRAPHIC COPYING MACHINE

[75] Inventor: Kenichi Handa, Ebina, Japan

[73] Assignee: Fuji Xerox Co., Ltd., Tokyo, Japan

[22] Filed: May 22, 1974

[21] Appl. No.: 472,375

[30] Foreign Application Priority Data

May 23, 1973 Japan ..... 48-56866

[52] U.S. Cl. ..... 118/637

[51] Int. Cl.[2] ..... B05B 5/02

[58] Field of Search ..... 118/637, 623; 117/17.5

[56] References Cited

UNITED STATES PATENTS

| | | | |
|---|---|---|---|
| 3,318,284 | 5/1967 | Hojo et al. | 118/637 |
| 3,392,432 | 7/1968 | Naumann | 117/17.5 X |
| 3,402,698 | 9/1968 | Kojima et al. | 117/17.5 |
| 3,455,276 | 7/1969 | Anderson | 118/637 |
| 3,543,720 | 12/1970 | Drexler | 118/637 |
| 3,572,289 | 3/1971 | Maksymiak | 117/17.5 |
| 3,641,980 | 2/1972 | Bickmore | 118/637 |
| 3,754,526 | 12/1971 | Caudill | 118/637 |
| 3,828,730 | 8/1974 | Yamashita | 118/637 |
| 3,839,992 | 10/1974 | Takahashi | 118/637 |

*Primary Examiner*—Ronald Feldbaum
*Attorney, Agent, or Firm*—Gerald J. Ferguson, Jr.; Joseph J. Baker

[57] ABSTRACT

A magnetic brush type developing mechanism is electronic copying machine characterized in that each of the developing rolls having a cylindrical multipole fixed magnet is provided with a magnetized pole or poles in other part than the developing region.

1 Claim, 1 Drawing Figure

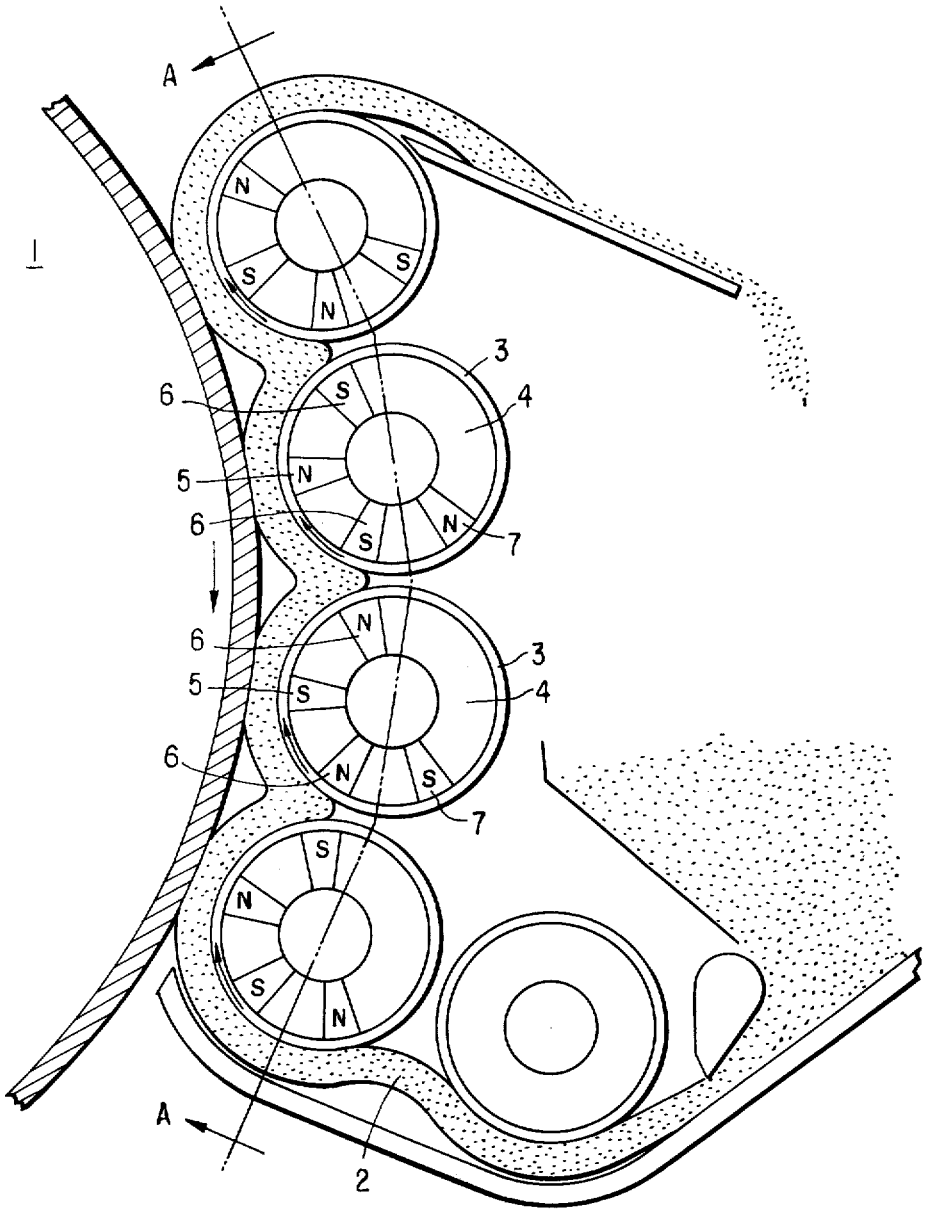
A
1
N
S
S
N
3
4
6
S
5
N
6
S
N
7
6
N
3
5
S
4
6
N
S
7
S
N
S
N
A
2

MAGNETIC BRUSH TYPE DEVELOPING MECHANISM IN ELECTROPHOTOGRAPHIC COPYING MACHINE

FIELD OF THE INVENTION

This invention relates to a magnetic brush type developing mechanism in an electrophotographic copying machine.

DESCRIPTION OF THE PRIOR ART

Generally, in the developing mechanism using so-called magnetic brushes, development is performed by supplying the developer, composed of a carrier and toner mixture, to a sensitive plate on the surface of a sensitive drum by means of developing rolls rotating around the respective fixed magnets and visualizing the electrostatic latent images on said sensitive plate with said developer. The developing capacity of the mechanism declines as the process speed increases. As a means for elevating such developing capacity, it is commonly practiced to increase the number of the developing rolls, but this could result in poor result of development or troubles in supply of the developer.

For the magnet fixed in the inside of each rectangular prismatic magnet or a multipole eylindrical magnet. In the case of the former type magnet, high accuracy is required for the setting angle of the magnet, while the latter has greater allowance for such setting angle.

SUMMARY OF THE INVENTION

The present invention is to provide a magnetic brush development mechanism including a plurality of developing rolls each of which has fixed therein a multipole cylindrical magnet, characterized in that each said developing roll is provided with a magnetized pole or poles in other part than the developing region to thereby obtain better result of development and improved developer feeding performance.

BRIEF DESCRIPTION OF THE DRAWING

The drawing is a side view of the principal parts of a developing mechanism embodying the present invention.

DESCRIPTION OF THE PREFERRED EMBODIMENT

Now, the invention is described in detail by way of an embodiment thereof with reference to the accompanying drawing.

In the drawing, reference numeral 1 designates a sensitive drum having disposed on its surface a sensitive plate on which the latent images are formed in a known method.

Numeral 2 indicates the developer including the toner for forming the visible images. Said developer 2 is fed into the developing section with rotation of the developing rolls 3 and contacted with the sensitive plate on said sensitive drum 1.

Each of said developing rolls 3 has fixed in its inside a cylindrical magnet. That is, each said developing roll 3 rotates around the surface of the fixed magnet 4 and is applied with a potential $V_{BIAS}$ smaller than the static potential $V_1$ of said latent images, whereby the negatively charged toner particles in said developer 2 are deposited on the image portions in said latent image surfaces to visualize the images, thus accomplishing the development.

In this embodiment, the arrangement pattern of said cylindrical magnet 4, which is a very important factor for obtaining good results of development, is such as follows. That is, as shown in the drawing, each said cylindrical magnet 4 is provided with a magnetized pole 5 on the side opposed to the sensitive drum 1 such that the opposite magnetic poles N and S will appear alternately on the adjoining magnets 4. This magnetized pole 5 conduces greatly to the developing operation. It is to be noted that the angle made by said pole 5 and the adjoining pole 6 of the opposite polarity is maximized so as to minimize attenuation of its magnetic force relative to the distance from the surface of the roll 3.

In order to better transportability of said developer 2, each magnet 4 may be provided with one or more said poles 6, in addition to said pole 5, within the developing region that extends from the imaginary line A—A to the side opposed to the sensitive drum 1. In this embodiment, as the angle made by said both adjoining poles 5 and 6 is maximized to better the developing performance, the pole 6 is positioned close to that of the adjacent magnet 4 to make the magnetic force too strong to obtain the best developer transportability, so that, in this embodiment, there is additionally provided another magnetized pole 7 on the side opposite from the developing region to thereby better transportability of the developer 2.

Although there has been shown and described above a magnetic brush type development mechanism provided with four pieces of developing rolls, that is, four magnetic brush rolls for development, and one piece of magnetic brush roll for feeding of the developer, the principles of the present invention can as well be applied to the developing mechanisms where more than two developing rolls are used, and all of such applications are embraced within the scope of the present invention.

Thus, according to the present invention, as described above in detail, since one or more magnetized poles are provided in other part than the developing area in each developing roll having a cylindrical multipole fixed magnet, there can be obtained a magnetic brush development mechanism with high developing performance and excellent developer transportability.

What is claimed is:

1. A magnetic brush developing apparatus for developing a latent image on a light sensitive member with toner, said apparatus comprising a plurality of rotatable developing rolls successively disposed adjacent said light sensitive member, all said rolls being rotated in the same direction;

a plurality of fixed cylindrical magnets respectively disposed within said rolls to effect movement of said toner between said light sensitive member and said developing rolls;

each said magnet having a first pole directly opposed to the surface of said light sensitive member where the polarity of each first pole is opposite to that of adjacent first poles so that the development of said latent image is emphasized;

each said magnet having two second poles of a polarity opposite to that of its first pole to improve the transportability of said toner, said second poles being disposed on opposite sides of said first pole and within a developing region defined between the surface of the light sensitive member and an imaginery line approximately extending through the centers of said cylindrical magnets, the angle between said first pole and said second poles being maximized to improve the development effected by each said first pole, at least some of said second poles of each magnet being substantially adjacent second poles of opposite polarity disposed on adjacent magnets, only said first and second poles being disposed with said developing region for each magnet;

each said magnet having a third pole of a polarity opposite to that of its second poles so disposed outside of said developing region with respect to one of its second poles that the tendency of adjacent second poles of adjacent cylindrical magnets to undesirably affect the transportability of the toner is minimized whereby the combination of said first, second and third poles of said cylindrical magnets tends to maximize both development of the latent image and transportability of the toner.

* * * * *